United States Patent [19]

Shatto

[11] Patent Number: 4,830,541

[45] Date of Patent: May 16, 1989

[54] SUCTION-TYPE OCEAN-FLOOR WELLHEAD

[75] Inventor: Howard L. Shatto, Houston, Tex.

[73] Assignee: Shell Offshore Inc., Houston, Tex.

[21] Appl. No.: 868,864

[22] Filed: May 30, 1986

[51] Int. Cl.[4] ..... E02D 29/00; E21B 33/043

[52] U.S. Cl. ..... 405/226; 166/368; 405/224

[58] Field of Search ..... 405/203, 204, 195, 224, 405/226, 228; 114/296; 417/172; 166/335, 368

[56] References Cited

U.S. PATENT DOCUMENTS

| | | | |
|---|---|---|---|
| 1,031,289 | 7/1912 | Pedley | 417/172 |
| 1,227,180 | 5/1917 | Murta | 417/172 |
| 1,465,664 | 5/1922 | Griesser . | |
| 2,080,623 | 5/1937 | McMahon | 417/172 |
| 2,475,888 | 9/1947 | Hackett | 61/46 |
| 3,263,641 | 8/1966 | Stimson | 114/296 |
| 3,319,923 | 4/1962 | Haeber et al. | 251/1 |
| 3,344,612 | 2/1966 | Rininger | 61/63 |
| 3,380,256 | 1/1966 | Rebikoff | 405/13 |
| 3,673,716 | 7/1972 | Trondle | 37/61 |
| 3,783,626 | 1/1974 | Hansen | 61/46.5 |
| 3,796,273 | 3/1974 | Rininger | 175/7 |
| 3,805,534 | 4/1974 | Brasted | 61/46.5 |
| 4,123,858 | 11/1978 | Batchelder | 37/56 |
| 4,127,950 | 12/1978 | Tillinghast | 37/62 |
| 4,180,349 | 12/1979 | van Bilderbeck | 405/224 |
| 4,253,255 | 3/1981 | Durell | 37/62 |
| 4,257,721 | 3/1981 | Haynes | 405/227 |
| 4,307,525 | 12/1981 | Maloblocki | 37/65 |
| 4,318,416 | 3/1982 | Hogervorst | 405/224 |
| 4,334,584 | 6/1982 | Magill | 175/5 |
| 4,432,671 | 2/1984 | Westra et al. | 405/226 |
| 4,558,744 | 12/1985 | Gibb | 405/226 |
| 4,575,282 | 3/1986 | Pardue, Sr. et al. | 114/296 |
| 4,576,518 | 3/1986 | Cooke et al. | 405/205 |
| 4,591,295 | 5/1986 | Collipp | 405/195 |

FOREIGN PATENT DOCUMENTS

| | | | |
|---|---|---|---|
| 299649 | 9/1954 | Switzerland | 417/172 |
| 654039 | 6/1949 | United Kingdom . | |
| 893167 | 7/1958 | United Kingdom . | |

OTHER PUBLICATIONS

Single Buoy Moorings Inc., Fribourg, Switzerland, "Suction Anchor System."

*Primary Examiner*—David H. Corbin

[57] ABSTRACT

A wellhead apparatus and a method for positioning the apparatus on the ocean floor in combination with means for sinking it into the ocean floor. The wellhead apparatus is equipped with a venturi suction device and a central opening for receiving a well conductor pipe. The apparatus provides a well base structure that is highly stable, capable of taking high vertical and lateral loads, and can be controlled during installation to be either truly plumb or positioned at a predetermined angle relative to the vertical.

33 Claims, 3 Drawing Sheets

SUCTION-TYPE OCEAN-FLOOR WELLHEAD

RELATED APPLICATIONS

This application is related by Applicant's copending application Ser. No. 781,338 filed on June 6, 1986.

FIELD OF THE INVENTION

This invention relates to an ocean-floor wellhead apparatus for use in drilling offshore oil and gas wells in combination with means for sinking it into the ocean floor and drilling a well therethrough.

BACKGROUND OF THE INVENTION

Deepwater wellheads of oil and gas wells are generally put in place by lowering a drill string having a bit at the bottom, boring hole in the ocean floor, and lowering a wellhead apparatus down the drill string. A large-diameter length of pipe is generally secured to the bottom of the wellhead, lowered into the drilled hole and centered therein.

Housing for wellhead equipment may consist of a subsea caisson having an open bottom that is lowered to the ocean floor and a pressure displacement dredging system to remove the soil inside the caisson. Such a device is set forth in U.S. Pat. No. 4,558,774 issued on Dec. 17, 1985. However, in this patent, apparatus in the caisson is used to remove the soil against its inner walls which eliminates soil friction inside the caisson which is positioned below the ocean floor.

It is also recognized that ship anchors have been positioned in the ocean floor by sucking them into the ocean floor in accordance with the method and apparatus disclosed in U.S. Pat. No. 4,432,671 issued on Feb. 21, 1984. However, the apparatus of this invention requires the use of a specially designed underwater motor-driven pump together with power-transmission cables which are removably connected to the anchor prior to installing the anchor in the ocean floor, and subsequently remotely disconnected from the anchor for removal to the ocean surface.

It is an object of the present invention to provide a well base structure that is highly stable, capable of taking high vertical and lateral loads, and can be controlled during installation to be either truly plumb or positioned at a predetermined angle relative to the vertical. Another object of the present invention is to provide an underwater wellhead apparatus that can be transported to the drilling location on a relatively small vessel and lowered to the ocean floor by means of a running pipe string. The apparatus, upon being positioned on the ocean floor, is subsequently sucked into the ocean floor by means of circulating fluid, such as water, down the running pipe string to actuate a suction device carried by the wellhead apparatus. The apparatus is anchored in the ocean floor by frictional resistance against both the internal and external walls of the apparatus. The apparatus is further provided with means whereby a well may be drilled through it into the ocean floor.

SUMMARY OF THE INVENTION

This invention relates to a wellhead apparatus and a method for positioning the apparatus on the ocean floor in combination with means for sinking it into the ocean floor. The wellhead apparatus is equipped with a venturi suction device and a central opening for receiving a well conductor.

A venturi suction device is provided on or stabbed into an open-bottom container assembly or arrangement of containers so that the suction device may be placed in fluid communication with ports through the upper end of the container assembly. The suction device may be conducted to a running pipe string used for lowering the wellhead apparatus from a vessel on the water surface to the ocean floor and sinking it thereinto.

Once the wellhead apparatus is lowered to the ocean floor, the angle of the wellhead apparatus relative to the vertical is determined. This may be done in any well-known suitable manner, as by a camera carried by an underwater remotely-operated vehicle (ROV) or a level-indicating device positioned on the wellhead apparatus. It may be desirable in some locations to position the wellhead apparatus at an angle, say 10 to 20 degrees, with respect to the vertical, such as in the case where the wellhead apparatus is to be positioned on the ocean floor so as to drill a well beneath a shipping lane in which a drilling vessel may not be positioned. If a level-indicating device is employed, it may be connected to a controller located on the apparatus or aboard a vessel from which, in turn, a signal can be transmitted to actuate valves carried by the container assembly for adjusting the wellhead apparatus to a predetermined angle relative to the vertical.

By means of a pump on the surface vessel, fluid is pumped down the running string, through the venturi of the suction device, and out an outlet port of the suction device so as to create suction within the container assembly. The suction is terminated by shutting off the pump on the surface vessel when the container assembly has penetrated the ocean floor to a selected depth.

The venturi suction device is then disconnected from the container assembly and raised with the running string to the water surface. Alternatively, the remaining pipe string may be disconnected from the venturi suction device which could be left on the container assembly.

A well conductor is then lowered from the surface vessel through the central opening of the wellhead apparatus to be seated on landing surfaces formed or supports connected to the container assembly which have a downwardly-directed opening therethrough.

An advantage of the present invention is that a solidly anchored wellhead apparatus may be positioned on the ocean floor to serve as a base for subsea drilling and/or production facilities such as drilling wellhead assembly which may include connectors, blow out preventers, etc. of a type well known to the art and used in drilling underwater wells.

Another advantage of the present invention is that it is not necessary to drill a hole in the ocean floor prior to installing the underwater wellhead or the platform on which the underwater wellhead is securely positioned during the drilling of a well.

A further advantage of the present invention is that it permits the drilling of a well into the ocean floor at a predetermined angle, say two to twenty degrees from the vertical. The present method and apparatus provides means for positioning an offshore wellhead at a selected angle relative to the vertical.

The various features of novelty which characterize the invention are pointed out with particularity in the claims forming a part of this disclosure. For a better understanding of the invention, its operating advantages and specific object obtained by its uses, references should be made to the accompanying drawings and descriptive matter in which there are illustrated preferred embodiments of the invention.

A BRIEF DESCRIPTION OF THE DRAWINGS

DESCRIPTION OF THE PREFERRED EMBODIMENT

Figure 1:
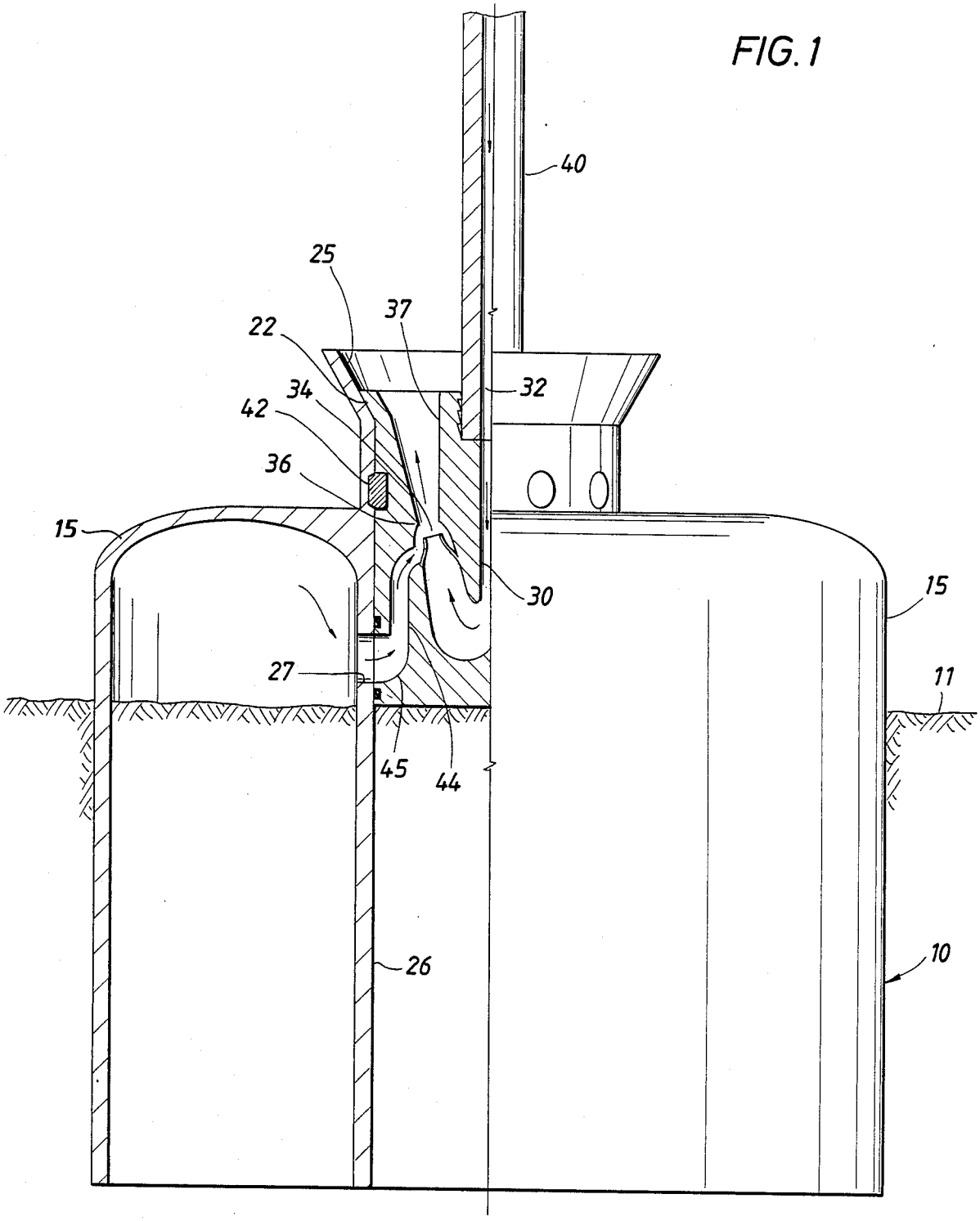
FIG. 1 is a view, taken in partial cross-section, of a wellhead apparatus after it has been sucked into the ocean floor.

Referring to FIG. 1 of the drawing, a wellhead apparatus represented herein by numeral 10, may comprise a plurality of open-bottomed containers 15 adapted to be sunk into the ocean floor 11 such that the tops of the containers are above the ocean floor 11 to form a base for well equipment. The container edges, when penetrating the ocean floor 11, provide a seal limiting the entry of water into the containers 15.

A venturi suction device 30 is engageable and disengageable with the wellhead apparatus 10. The suction device 30 has a throughbore 32 and is secured to and lowered by a conduit 40, such as running pipe string, extending from the ocean floor 11 to a point above the water surface. The suction device 30 may be provided with means for seating the suction device 30 adjacent the top of the container 15 and means for orienting and aligning the ports 45 of the suction device with the ports 27 of the sleeve 26.

The container 15 shown in FIG. 1 is provided with a landing surface 25 to engage a well conductor (not shown) or the landing surface 22 of the suction device 30. The sleeve 26 of the container 15 is centrally positioned in the wellhead apparatus 10 and extends downwardly from the landing surface 25 of the container 15. The sleeve 26 has ports 27 through the wall near the upper end of the container 15 and is in communication with the interior of the container 15. The top of the sleeve is formed in a manner to receive the suction device 30 and is lowerable by the conduit 40 from a vessel on the ocean surface or by other suitable means.

Suitable cooperating connector means, diagrammatically represented by numeral 42, carried by the suction device 30 and wellhead apparatus 10 connects the wellhead apparatus 10 to the suction device 30 in a weight-supporting and fluid-communication manner. Alternatively, the connector means 42 may have two engageable portions, one portion being carried by the suction device 30 and the other portion being carried by the upper end of the sleeve 26 of the wellhead apparatus 10.

Fluid conduit means 44 of the suction device 30 are in communication with the interior of the container 15 and the venturi suction ports 45. The fluid conduit means 44 include at least one port 27 through the wall of the container 15 near its upper end.

Figure 2:
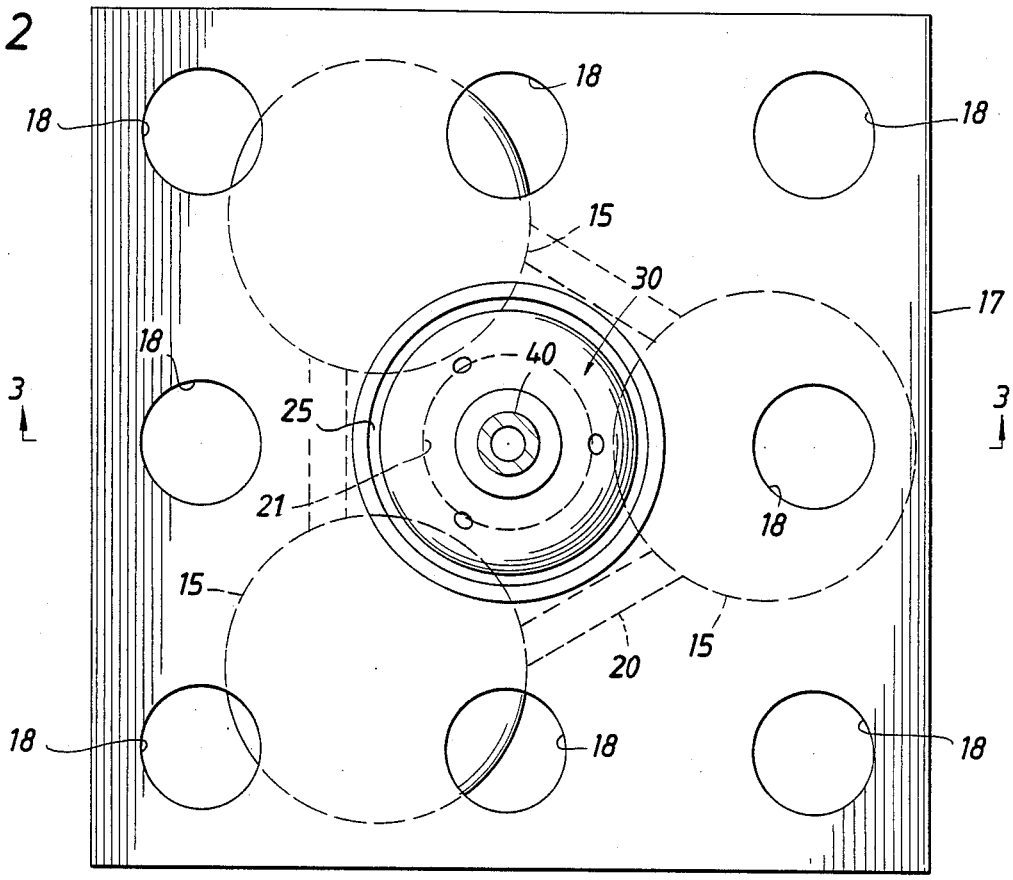
FIG. 2 is a plan view of another embodiment of a wellhead apparatus having a base plate for supporting well equipment.

A base 17, as shown in FIG. 2, may be connected to the tops of a plurality of containers 15 to provide a surface for supporting equipment associated with the use of the wellhead apparatus 10. Holes 18 may be provided in the base 17 to permit the base 17 to be more easily lowered from a vessel on the water surface to the ocean floor 11. The plurality of containers 15 shown in FIG. 2 are positioned in the ocean floor 11 in close fixed proximity to each other. Support means 20, such as a substantially horizontal plate, is secured to the containers forming the wellhead apparatus 10 and has a downwardly directed opening 21 therethrough for receiving a well conductor.

Figure 3:
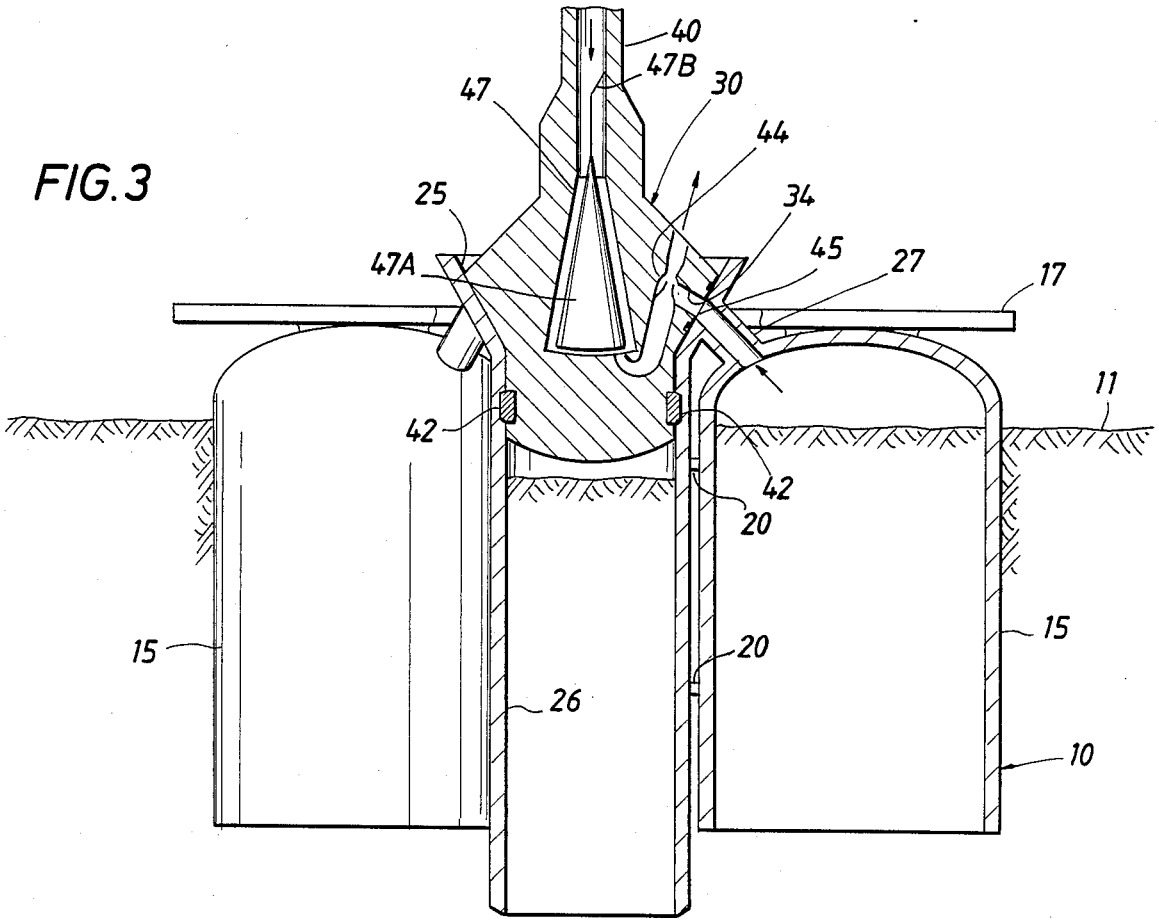
FIG. 3 is a cross-sectional view taken along the line 3—3 of FIG. 2 of a pendulum device used to control evacuation of water from a wellhead apparatus.

The suction device 30 may comprise a pendulum-type valve, flow controller, or adjustable closure device 47 (FIG. 3) to selectively open the suction ports 34 in response to the angle of the containers 15 relative to the vertical during normal operations in the illustrated embodiment of FIG. 3, the pendulum-type valve has a pendulum 47a suspended from a conduit 40 by a suspending support 47B.

Figure 4:
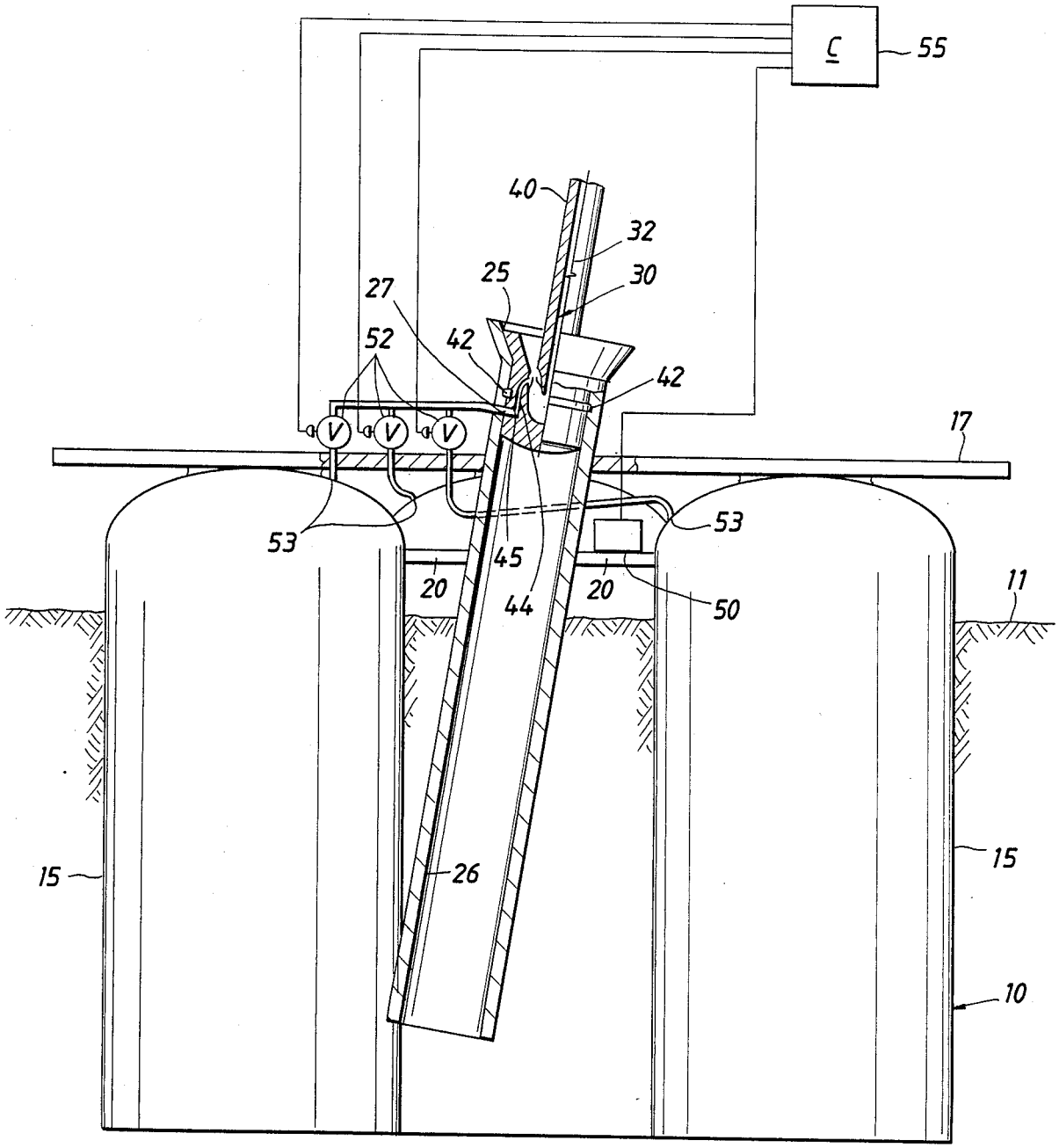
FIG. 4 is a schematic view of a level-indicating device, controller, and remotely-actuated valves on the wellhead apparatus.

FIG. 4 illustrates a wellhead apparatus 10 including level-indicating means 50 in communication with the containers 15 to determine the angle of the containers 15 relative to the vertical. The level-controlling system may include level-indicating means 50, valves 52 connected in communication with the ports 53 of the containers 15 for selectively evacuating water from the selected containers 15, and controller means 55 in communication with the level-indicating means 50 and the valves 52 to selectively open the valves 52 based on the desired angle that the containers 15 are to be positioned relative to the vertical.

Referring to FIG. 1, the method for positioning the wellhead apparatus 10 and sinking it into the ocean floor 11, comprises the initial step of connecting the suction device 30 to the lower end of the conduit 40 in a manner such that the suction device 30 is in fluid communication with the container 15. That is, the suction device 30 is seated and aligned with the container 15 so that one suction port 45 is in communication with the container port 27 and the other suction port 34 is in communication with the throughhole 32 of the conduit 40. Conduit 40 may be added until the wellhead apparatus 10 is on the ocean floor 11.

Then, it is determined whether the container 15 is at the desired angle relative to the vertical. This may be done in any manner well known to the art such as a camera carried by an underwater remotely-operated vehicle (ROV) or a level-indicating device 50 (FIG. 4). A signal is transmitted from the level-indicating means 50 to a controller means 55 to indicate the angle of the containers 15 relative to the vertical. The position indicated by the controller means 55, located on the apparatus 10 or aboard a service vessel, for example, is compared with a selected predetermined angle of the containers 15 relative to the vertical. If angular adjustment of the containers 15 is necessary, a signal is transmitted from the controller means 55 to actuate the valve means 52 carried by the container 15 selectively according to the desired angle of the containers 15 relative to the vertical.

To sink the container 15 into the ocean floor 11 to a selected depth (FIG. 1), fluid is pumped down the conduit 40, through the venturi suction device 30, and out of the outlet port means 37 to create suction within the container 15. The wellhead apparatus 10 is anchored in the ocean floor 11 by frictional resistance against both the internal and external walls of the container 15. Should it become necessary to adjust the angle of the wellhead apparatus 10 relative to the vertical after the apparatus 10 has been sunk into the ocean floor 11, fluid may be pumped down the conduit 40 and into the apparatus 10 to increase the pressure within the apparatus 10 to release the suction within the container 15. When the container 15 has sunk into the ocean floor to a selected depth and angle, the suction within the container 15 is terminated and the suction device 30 is disconnected from the container 15. The suction device 30 and associated conduit 40 are then raised to the water surface. Alternatively, the conduit 40 may be disconnected from the suction device 30 which could be left on the wellboard apparatus 10.

A well conductor (not shown) is then lowered from the surface vessel through the central opening of the wellhead apparatus 10 to be seated on the landing surfaces 25 of the container 15 having a downwardly-directed opening therethrough.

Alternatively, the apparatus 10 may be positioned on the ocean floor 11 in accordance with the present invention to serve as a base for subsea drilling and production facilities such as a template (not shown) for drilling a multiplicity of wells, or as an ocean-floor base for oil and/or gas manifold systems, production or separator equipment, underwater storage facilities, pipelines, underwater mining facilities, etc.

Thus, it can be seen that the above-mentioned objective may be accomplished, based on the description of the preferred embodiment, by practicing the above-mentioned method.

What is claimed is:

1. A wellhead apparatus adapted to be positioned on the ocean floor in combination with means for sinking an anchoring portion thereof into the ocean floor, said combination comprising:

open bottomed container means forming the anchoring portion of said apparatus and being adapted to be sunk into the ocean floor with both sides of the container means being in contact with the ocean floor and having the top of said container means above the ocean floor to form a base for well equipment;

support means connected to said container means at the upper end thereof above the ocean floor, said support means having a downwardly-directed opening therethrough for receiving a well conductor therein;

landing surface means formed adjacent said opening above the ocean floor and carried by said support means, said landing surface means being adapted to engage a well conductor positioned in said opening;

venturi suction means operatively engageable and disengageable with the top of the wellhead apparatus being located substantially level with the top of the container means for evacuating fluid from the top of said container means located above the ocean floor without disturbing that portion of the ocean floor within the container means which is in frictional contact with the inner wall of said container means, said suction means having a throughbore and suction port means at the throat of the venturi throughbore and being adapted to be secured to the lower end of, and be lowered by conduit means extending from the ocean floor to a point above the water surface;

cooperating connector means carried by said suction means and said wellhead apparatus for connecting said wellhead apparatus to said suction means in a weight-supporting and fluid-communication manner; and fluid conduit means in communication between the interior of said container means and the venturi suction port means.

2. The apparatus of claim 1 wherein said fluid conduit means includes port means through the wall of said container means near the upper end thereof.

3. The apparatus of claim 1 wherein the support means is fixedly secured to said wellhead apparatus.

4. The apparatus of claim 1 wherein said support means comprises substantially horizontal plate means having a centrally positioned downwardly-directed hole therethrough.

5. The apparatus of claim 1 wherein said container means comprises:

a plurality of container means adapted to be positioned in the ocean floor in close fixed proximity to each other, each of said container means having port means through the wall thereof near the upper end thereof;

venturi suction means having suction port means in communication with each of said container port means for evacuating water from said container means and applying a vacuum thereto; and a plurality of fluid conduit means in communication between the interior of each of said container means and said suction port means.

6. The apparatus of claim 1 including sleeve means centrally positioned in said wellhead apparatus and extending downwardly from said landing surface means of said support means.

7. The apparatus of claim 6 wherein the sleeve means of said container means includes port means through the wall near the upper end of said container means and in communication therewith.

8. The apparatus of claim 6 wherein the top of said sleeve is formed in a manner to receive said suction means and is lowerable by said conduit means from a vessel on the ocean surface.

9. The apparatus of claim 7 wherein said suction means includes means for seating said suction means adjacent the top of said container means.

10. The apparatus of claim 7 wherein said connector means forms two portions, one portion being carried by said suction means and the other portion being carried by the upper end of said sleeve of said wellhead apparatus.

11. The apparatus of claim 1 wherein said container means edges when penetrating the ocean floor provide a seal limiting the entry of water into said container means.

12. The apparatus of claim 5 wherein said suction means includes valve means for selectively opening said suction port means in response to the angle of said containers means relative to the vertical during normal operations.

13. The apparatus of claim 12 wherein said valve means includes a pendulum type closure device to selectively open said suction ports in response to the angle of said container means relative to the vertical during normal operations.

14. The apparatus of claim 5 wherein said wellhead apparatus includes level-indicating means in communication with said container means to determine the angle of said container means relative to the vertical.

15. The apparatus of claim 14 wherein said level-indicating means comprises:

valve means carried by said apparatus in fluid communication with said port means of said container means for selectively evacuating water therefrom; and controller means in communication with said level-indicating means and said valve means to selectively open said valve means based on the desired angle of said containers relative to the vertical.

16. A method of positioning a wellhead apparatus and sinking it into the ocean floor, the method comprising the steps of:

providing open-bottomed container means having an open-end sleeve to receive a well conductor;

providing port means near the top of the wall of said container means for evacuating water therefrom;

providing venturi suction means operatively engageable with said container means and having suction port means, said suction means being adapted to be secured to and lowered by said conduit means;

providing fluid conduit means in communication between the interior of said container means and said suction port means;

connecting said suction means to the lower end of said conduit means;

stabbing said suction means into fluid communication with said container means;

seating and aligning said suction means so that one inlet port means of said suction means is in communication with one port means of said container means and the other inlet port means of said suction means is in communication with the throughbore of said conduit means;

lowering said conduit means until the wellhead apparatus is on the ocean floor;

determining whether said container means is at the desired angle relative to the vertical;

adjusting the angle of said container means relative to the vertical, pumping fluid down the conduit means, through the venturi of said suction means, and out of the outlet port means of said suction means to create suction within said container means;

terminating the suction within the container means when said container means has sunk into the ocean floor to a selected depth;

disconnecting said suction means from said container means; and raising the suction means and associated conduit means to the ocean surface.

17. The method of claim 16 wherein the step of adjusting includes the steps of:

providing a level-indicating means in communication with said container means to determine the position of said container means relative to the vertical;

providing valve means in fluid communication with said port means of said container means for selectively evacuating water therefrom;

providing controller means in communication with said level-indicating means and said valve means to open or close said valve means;

transmitting a signal from said level-indicating means to said controller means to indicate the angle of said containers relative to the vertical; and comparing the position indicated by the controlled means with a selected predetermined angle of said container means relative to the vertical.

18. The method of claim 17 including the step of transmitting a signal from said controller means to actuate said valve means selectively according to the desired angle of said container means relative to the vertical.

19. The method of claim 16 wherein the step of adjusting includes the step of pumping fluid down said conduit means and through said apparatus to release the suction within said container means.

20. A subsea apparatus adapted to be positioned on the ocean floor in combination with means for sinking it into the ocean floor, said combination comprising;

open-bottomed container means adapted to be sunk into the ocean floor having the top of said container means above the ocean floor to form a base for well equipment;

venturi suction means operatively engageable and disengageable with said subsea apparatus, said suction means having a throughbore and suction port means at the throat of the venturi throughbore and being adapted to be secured to the lower end of, and be lowered by, conduit means extending from the ocean floor to a point above the water surface;

cooperating connector means carried by said suction means and said subsea apparatus for connecting said subsea apparatus to said suction means in a weight-supporting and fluid-communication manner; and fluid conduit means in communication between the interior of said container means and the venturi suction port means.

21. A wellhead apparatus adapted to be positioned on the ocean floor in combination with means for sinking an anchoring portion thereof into the ocean floor, said combination comprising:

open-bottomed container means forming the anchoring portion of said apparatus and being adapted to be sunk into the ocean floor with both sides of the container means being in contact with the ocean floor and having the top of said container means above the ocean floor to form a base for well equipment;

support means connected to said container means at the upper end thereof above the ocean floor, said support means having a downwardly-directed opening therethrough for receiving a well conductor therein;

landing surface means formed adjacent said opening above the ocean floor and carried by said support means, said landing surface means being adapted to engage a well conductor positioned in said opening;

venturi suction means operatively engageable and disengageable with the top of the wellhead apparatus being located substantially level with the top of the container means for evacuating fluid from the top of said container means located above the ocean floor without disturbing that portion of the ocean floor within the container means which is in frictional contact with the inner wall of said container means, said suction means having a throughbore and suction port means at the throat of the venturi throughbore and being adapted to be secured to the lower end of, and be lowered by conduit means extending from the ocean floor to a point above the water surface;

sleeve means centrally positioned in said wellhead apparatus and extending downwardly from said landing surface means of said support means wherein the sleeve means of said container means includes port means through the wall near the upper end of said container means and in communication therewith;

cooperating connector means carried by said suction means and said wellhead apparatus for connecting said wellhead apparatus to said suction means in a weight-supporting and fluid-communication manner wherein said connector means forms two portions, one portion being carried by said suction means and the other portion being carried by the upper end of said sleeve of said wellhead apparatus; and fluid conduit means in communication between the interior of said container means and the venturi suction port means.

22. A wellhead apparatus adapted to be positioned on the ocean floor in combination with means for sinking an anchoring portion thereof into the ocean floor, said combination comprising:

open-bottomed container means forming the anchoring portion of said apparatus and being adapted to be sunk into the ocean floor with both sides of the container means being in contact with the ocean floor and having the top of said container means above the ocean floor to form a base for well equipment, said container means having a plurality of containers adapted to be positioned in the ocean floor in close fixed proximity to each other, each of said containers having port means through the wall thereof near the upper end thereof;

support means connected to said container means at the upper end thereof above the ocean floor, said support means having a downwardly-directed opening therethrough for receiving a well conductor therein;

landing surface means formed adjacent said opening above the ocean floor and carried by said support means, said landing surface means being adapted to engage a well conductor positioned in said opening;

venturi suction means operatively engageable and disengageable with the top of the wellhead apparatus being located substantially level with the top of the container means for evacuating fluid from the top of said container means located above the ocean floor without disturbing that portion of the ocean floor within the container means which is in frictional contact with the inner wall of said container means, said suction means having a throughbore and being adapted to be secured to the lower end of, and be lowered by conduit means extending from the ocean floor to a point above the water surface, said venturi suction means having suction port means in communication with each of said container port means for evacuating water from said container means and applying a vacuum thereto wherein said suction means includes valve means for selectively opening said suction port means in response to the angle of said containers means relative to the vertical during normal operations;

a plurality of fluid conduit means in communication between the interior of each of said container means and said suction port means;

cooperating connector means carried by said suction means and said wellhead apparatus for connecting said wellhead apparatus to said suction means in a weight-supporting and fluid-communication manner; and fluid conduit means in communication between the interior of said container means and the venturi suction port means.

23. A wellhead apparatus adapted to be positioned on the ocean floor in combination with means for sinking an anchoring portion thereof into the ocean floor, said combination comprising:

open-bottomed container means forming the anchoring portion of said apparatus and being adapted to be sunk into the ocean floor with both sides of the container means being in contact with the ocean floor and having the top of said container means above the ocean floor to from a base for well equipment, said container means having a plurality of containers adapted to be positioned in the ocean floor in close fixed proximity to each other, each of said containers having port means through the wall thereof near the upper end thereof;

support means connected to said container means at the upper end thereof above the ocean floor, said support means having a downwardly-directed opening therethrough for receiving a well conductor therein;

landing surface means formed adjacent said opening above the ocean floor and carried by said support means, said landing surface means being adapted to engage a well conductor positioned in said opening;

venturi suction means operatively engageable and disengageable with the top of the wellhead apparatus being located substantially level with the top of the container means for evacuating fluid from the top of said container means located above the ocean floor without disturbing that portion of the ocean floor within the container means which is in frictional contact with the inner wall of said container means, said suction means having a throughbore and suction port means at the throat of the venturi throughbore and being adapted to be secured to the lower end of, and be lowered by conduit means extending from the ocean floor to a point above the water surface, said venturi suction means having suction port means in communication with each of said container port means for evacuating water from said container means and applying a vacuum thereto wherein said suction means includes valve means for selectively opening said suction port means in response to the angle of said containers means relative to the vertical during normal operations;

a plurality of fluid conduit means in communication between the interior of each of said container means and said suction port means;

cooperating connector means carried by said suction means and said wellhead apparatus for connecting said wellhead apparatus to said suction means in a weight-supporting and fluid-communication manner;

fluid conduit means in communication between the interior of said container means and the venturi suction port means; and level-indicating means in communication with said container means to determine the angle of said container means relative to the vertical.

24. The apparatus of claim 23 wherein the valve means is carried by said apparatus in fluid communication with said port means of said container means for selectively evacuating water therefrom, and said level-indicating means further comprises controller means in communication with said levelindicating means and said valve means to selectively open said valve means based on the desired angle of said containers relative to the vertical.

25. A method of positioning a wellhead apparatus and sinking it into the ocean floor, the method comprising the steps of:

providing open-bottomed container means having an open-end sleeve to receive a well conductor;

providing port means near the top of the wall of said container means for evacuating water therefrom;

providing venturi suction means operatively engageable with said container means and having suction port means, said suction means being adapted to be secured to and lowered by said conduit means;

providing fluid conduit means in communication between the interior of said container means and said suction port means;

providing a level-indicating means in communication with said container means to determine the position of said container means relative to the vertical;

providing valve means in fluid communication with said port means of said container means for selectively evacuating water therefrom;

providing controller means in communication with said level-indicating means and said valve means to open or close said valve means;

connecting said suction means to the lower end of said conduit means;

stabbing said suction means into fluid communication with said container means;

seating and aligning said suction means so that one inlet port means of said suction means is in communication with one port means of said container means and the other inlet port means of said suction means is in communication with the throughbore of said conduit means;

lowering said conduit means until the wellhead apparatus is on the ocean floor;

determining whether said container means is at the desired angle relative to the vertical wherein said determining includes transmitting a signal from said level-indicating means to said controller means to indicate the angle of said containers relative to the vertical;

comparing the position indicated by the controller means with a selected predetermined angle of said container means relative to the vertical;

adjusting the angle of said container means relative to the vertical;

pumping fluid down the conduit means, through the venturi of said suction means, and out of the outlet port means of said suction means to create suction within said container means;

terminating the suction within the container means when said container means has sunk into the ocean floor to a selected depth;

disconnecting said suction means from said container means; and raising the suction means and associated conduit means to the ocean surface.

26. A subsea apparatus adapted to be positioned on the ocean floor in combination with means for sinking an anchoring portion thereof into the ocean floor, said combination comprising:

open-bottomed containing means forming the anchoring portion of said apparatus and being adapted to be sunk into the ocean floor with both sides of the containing means being in contact with the ocean floor and having the top of said containing means above the ocean floor to form a base for well equipment;

supporting means connected to said containing means at the upper end thereof above the ocean floor, said supporting means having a downwardly-directed opening therethrough for receiving a well conductor therein;

landing means formed adjacent said opening above the ocean floor and carried by said support means, said landing means being adapted to engage a well conductor positioned in said opening; and venturi suctioning means operatively engageable and disengageable with the top of the subsea apparatus being located substantially level with the top of the containing means for evacuating fluid from the top of said containing means located above the ocean floor without disturbing that portion of the ocean floor within the containing means which is in frictional contact with the inner wall of said containing means.

27. The apparatus of claim 26 including at least one sleeve centrally positioned in said subsea apparatus and extending downwardly from said landing means of said supporting means wherein said sleeve of said containing means includes opening means through the wall near the upper end of said containing means and in communication therewith.

28. The apparatus of claim 26 including cooperating connecting means carried by said suctioning means and said subsea apparatus for connecting said subsea apparatus to said suctioning means in a weight-supporting and fluid-communication manner.

29. The apparatus of claim 27 including cooperating connecting means carried by said suctioning and said subsea apparatus for connecting said subsea apparatus to said suctioning means in a weight-supporting and fluid-communication manner wherein said connecting means forms two portions, one portion being carried by said suctioning means and the other portion being carried by the upper end of said sleeve of said subsea apparatus.

30. The apparatus of claim 26 wherein said containing means includes a plurality of containers adapted to be positioned in the ocean floor in close fixed proximity to each other, each of said containers having opening means through the wall thereof near the upper end thereof.

31. The apparatus of claim 30 including level-indicating means in communication with each of said containing means to determine the angle of each of said containing means relative to the vertical.

32. The apparatus of claim 31 wherein said level-indicating means comprises:

valving means carried by said apparatus in fluid communication with said opening means of said containing means for selectively evacuating water therefrom, and controlling means in communication with said level-indicating means and said valving means to selectively to open said valving means based on the desired angle of said containers relative to the vertical.

33. A method of positioning a subsea wellhead apparatus and sinking it into the ocean floor, the method comprising the steps of:

supporting a well conductor receiving sleeve within a subsea wellhead apparatus having a plurality of open-bottomed containing means;

lowering the subsea wellhead apparatus until the apparatus is on the ocean floor;

determining whether said subsea wellhead apparatus is at the desired angle relative to the vertical;

adjusting the angle of said subsea wellhead apparatus relative to the vertical;

pumping fluid through a venturi-suctioning means in communication with the containing means to create suction within said containing means; and terminating suction within said containing means when said containing means have sunken into the ocean floor.

* * * * *